US009877101B2

(12) United States Patent
Boyajian et al.

(10) Patent No.: US 9,877,101 B2
(45) Date of Patent: Jan. 23, 2018

(54) HEADPHONE SYSTEM WITH DETACHABLE EARBUD SPEAKERS

(75) Inventors: Adam Gary Peter Boyajian, Upper Saddle River, NJ (US); Michael Orlando Parelli, Greenwich, CT (US); Eric Anthony Knight, Unionville, CT (US)

(73) Assignee: Remarkable Technologies, Inc., Avon, CT (US)

( * ) Notice: Subject to any disclaimer, the term of this patent is extended or adjusted under 35 U.S.C. 154(b) by 0 days.

(21) Appl. No.: 13/571,147

(22) Filed: Aug. 9, 2012

(65) Prior Publication Data

US 2013/0156247 A1 Jun. 20, 2013

Related U.S. Application Data

(60) Provisional application No. 61/530,572, filed on Sep. 2, 2011.

(51) Int. Cl.

| | |
|---|---|
| ***H04R 25/00*** | (2006.01) |
| ***H04R 1/10*** | (2006.01) |
| ***H04R 1/30*** | (2006.01) |

(52) U.S. Cl.

CPC ..... *H04R 1/105* (2013.01); *H04R 1/30* (2013.01); *H04R 1/1008* (2013.01); *H04R 1/1016* (2013.01)

(58) Field of Classification Search

USPC ..... 381/381, 376, 367, 340, 342, 382

See application file for complete search history.

(56) References Cited

U.S. PATENT DOCUMENTS

| | | | | |
|---|---|---|---|---|
| 5,625,903 | A * | 5/1997 | Schultz et al. | 2/209 |
| 7,110,563 | B2 * | 9/2006 | Bergere | H04R 1/26 381/371 |
| 7,289,641 | B2 * | 10/2007 | Yang | H04R 1/1075 381/309 |
| 7,869,615 | B2 * | 1/2011 | Chang | H04R 1/10 381/371 |
| 2007/0248238 | A1 * | 10/2007 | Abreu | 381/381 |
| 2008/0080733 | A1 * | 4/2008 | Mei | H04R 1/1066 381/379 |

* cited by examiner

*Primary Examiner* — Amir Etesam

(57) ABSTRACT

A headphone and earbud device for receiving an audio signal may include a headphone including a speaker acoustic device to amplify the audio signal and to define a speaker chamber to cooperate with an aperture and an earbud to be detachably connected to the speaker chamber to transmit the audio signal to the speaker chamber.

20 Claims, 18 Drawing Sheets

HEADPHONE SYSTEM WITH DETACHABLE EARBUD SPEAKERS

PRIORITY

The present invention claims priority under 35 USC section 119 and based upon a provisional application which was filed on Sep. 2, 2011 with a Ser. No. of 61/530,572

FIELD OF THE INVENTION

The present invention relates to the field of acoustics and more particularly to the fields of headphones and earbuds.

BACKGROUND

The distinction and advantages between headphones and earbuds has been repeatedly discussed by the users of each. Evidently, each one has its own strengths and weaknesses across a wide range of audio scenarios. Headphones may be good in a stationary, at home or in the studio environment. Headphone users typically may choose headphones for their better sound quality, noise-canceling capabilities and comfortable fit on the head/ears. Earbuds may come in handy when users are on-the-go, and need a quick and simple way of listening to audio that can be easily stored in their pocket or bag.

However, headphones and earbuds both have disadvantages of their own; headphones can be bulky, overly expensive, difficult to adjust to a perfect fit, and difficult to take on-the-go because of their larger size. Earbuds may be uncomfortable, fall out of the ears, produce less quality sound, and cause more hearing loss/damage. Earbuds may be easily damaged as they are wrapped around mp3 players, and stuffed in pockets and bags.

SUMMARY

The present invention includes headphones which may be adapted to detachably connect to earbuds.

A headphone and earbud device for receiving an audio signal may include a headphone including a speaker acoustic device to amplify the audio signal and to define a speaker chamber to cooperate with an aperture and an earbud to be detachably connected to the speaker chamber to transmit the audio signal to the speaker chamber.

The ear bud may be frictionally connected to the speaker chamber.

The earbud may include a earbud speaker to cooperate with the aperture.

The headphone may include an ear cushion member.

The speaker acoustic device may be a trumpet shaped device.

The speaker acoustic device may include a truncated cone shaped device.

The trumpet shaped device may include a neck which reverses in direction.

The truncated cone device may include a concave surface.

The truncated cone device may include a convex surface.

The speaker acoustic device may include a plurality of trumpet shaped devices.

The plurality of trumpet shaped devices may extend from a common base.

The headphone may include an earbud containing compartment for storing the earbuds.

The speaker acoustic device may include an amplification device.

The amplification device may be a microphone.

The headphone may include a first headphone and a second headphone.

The first headphone and the second headphone may be foldable.

The first headphone may be connected to the second headphone by a headband.

The headband may telescope from a first position to a second position in order to accommodate various users head size.

The headphone may include a connector to rotate the first headphone with respect to the second headphone.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Today, there is a nearly equal demand for both headphones and earbuds. So by combining the two into one versatile product possessing the benefits of each, users will not have to choose between the two, or buy both separately.

With the present invention, versatile headphones of the present invention may be used as headphones or may be used with earbuds. The present invention may include of a pair of over-ear headphones, but with or without the built in speakers mounted inside the headphones. Instead, the audio may be supplied from earbud which may be detachably connected into an aperture on the outer side of each headphone. The aperture may be audio connected to a device that actively amplifies the acoustic audio from the earbud.

In one example, the earbud may be positioned at the base of a truncated cone shaped piece (kind of like a classic megaphone); this way the audio from the earbud may be enhanced and amplified as the audio enters the headphone, thus improving the users listening experience.

In another example, the headphone may include a miniature megaphone, microphone, or another electronic sound amplifier built into each headphone. When the earbud is connected to the headphone, the audio from the earbud may be amplified and enhanced electronically to make the headphones sound louder and clearer, thus making it closer to the experience of a pair of headphones without the earbuds.

For the non-electric audio amplifier cone the present invention may employ a speaker acoustic device as described below.

When the combination of earbuds and headphones are no longer desired, the user simply detaches the earbuds from the headphone, and then the user may have a pair of in-ear earbuds to use in the traditional way.

Also, the headphones may include a compartment that is capable of storing the earbuds when they are not being used with the headphones. The user would wrap the earbuds up, take off the headphone cushion/cover and place them inside the compartment of the headphone for safe keeping.

Advantages

- The present invention provides the comfort, quality sound, and noise-cancellation capabilities of headphones and the versatility of earbuds as desired by the user.
- The present invention provides only one pair of our versatile headphones, eliminating the need for 2 separate pairs of headphones and earbuds.
- Earbud sound quality is now enhanced into headphone quality audio
- If the headphone wires fray, the headphones may still be used with a new pair of earbuds providing working headphones and earbuds.
- The present invention eliminates the need to sloppily wrap your headphone wire around the headphones or an mp3 player. The compartment within the headphone provides storage for earbuds and wires. Also, this can extend the life of a pair of earbuds.

Figure 1:
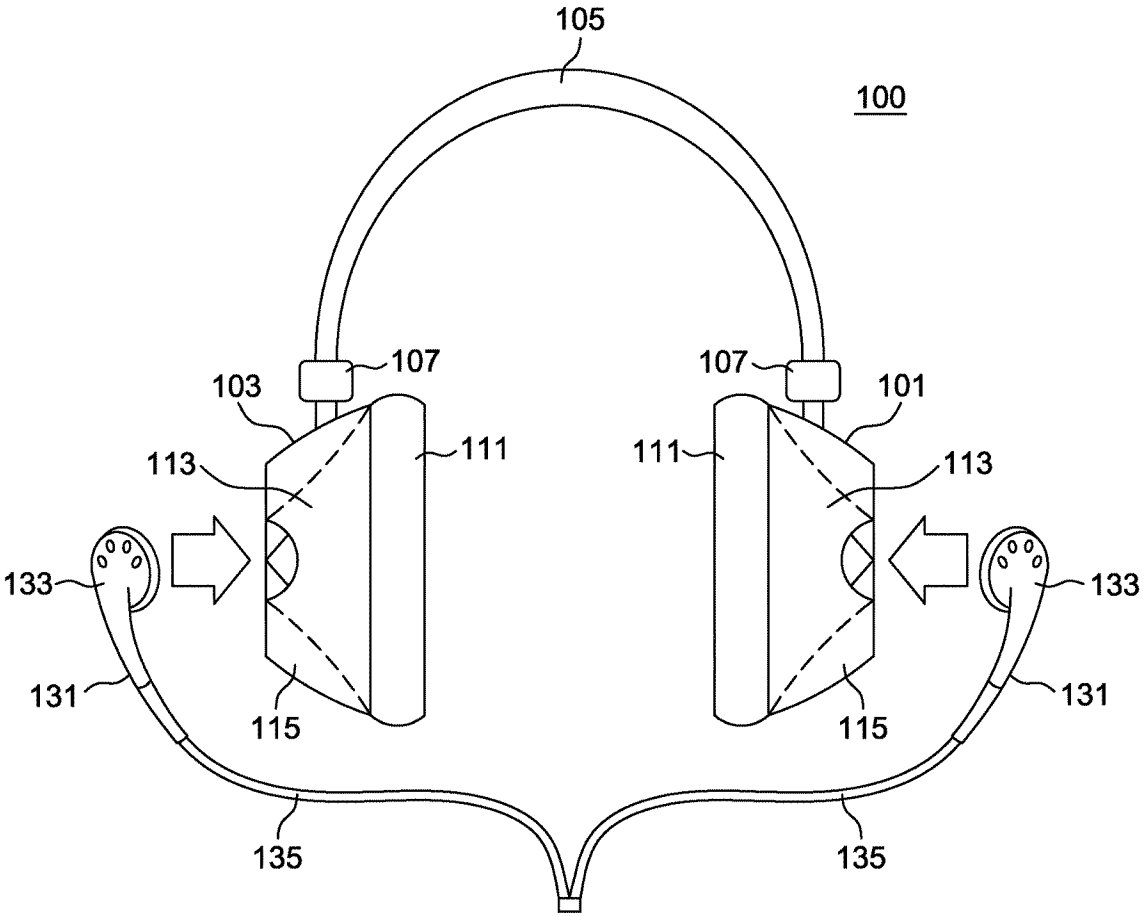
FIG. 1 illustrates a front view of the headphone and earbuds device of the present invention.

FIG. 1 illustrates a front view of the headphone and ear buds device 100 of the present invention which may include a first headphone 101 and a near mirror second headphone 103. The description of the first headphone 101 may apply equally to the second headphone 103. The first headphone 101 may be connected to the second headphone 103 by a headphone headband 105 which may be substantially U-shaped, adjustable and flexible in order to accommodate varying users head sizes. The headphone headband 105 may include a connector 107 with the first headphone 101 and the second headphone 103 to allow the respective headphone 101, 103 to pivot and rotate to provide a swivel operation. Each headphone 101, 103 may include a headphone aperture 109 which may or may not interfere with the operation of the headphone 101, 103 and may be substantially centered on the exterior surface (distal side) of the headphone 101, 103. The headphone 101, 103 may include an ear cushion member 111 which may be a elongated flexible ring to cushion the headphone 101, 103 from the ear of the user and may include a speaker acoustic device 113 which may include a speaker chamber 115 which may be dome shaped and may cooperate with ear cushion member 111.

FIG. 1 illustrates the earbud device 131 which may include an earbud speaker 133 which may be connected to an earbud wire 135 which may be flexible and connect to the earbud speaker 133 to allow the earbud speaker 133 to receive audio signals from an audio source (not shown). The earbud speaker 133 may cooperate with the aperture 109 to achieve a detachable connection for example by a friction fit.

FIG. 1 additionally illustrates headphone speaker wire 135 to provide audio signals to the headphone 101, 103.

Figure 2:
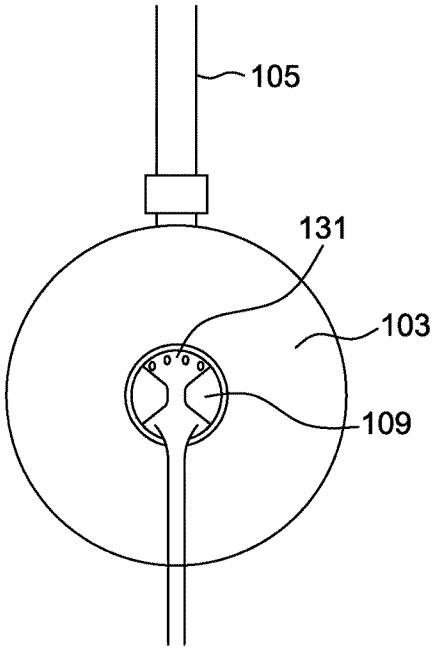
FIG. 2 illustrates a side view of the headphone and earbuds device of the present invention.

FIG. 2 illustrates a side view of the headphone 103 which may include headphone headband 105 and illustrates an earbud device 131 inserted in the aperture 109.

Figure 3:
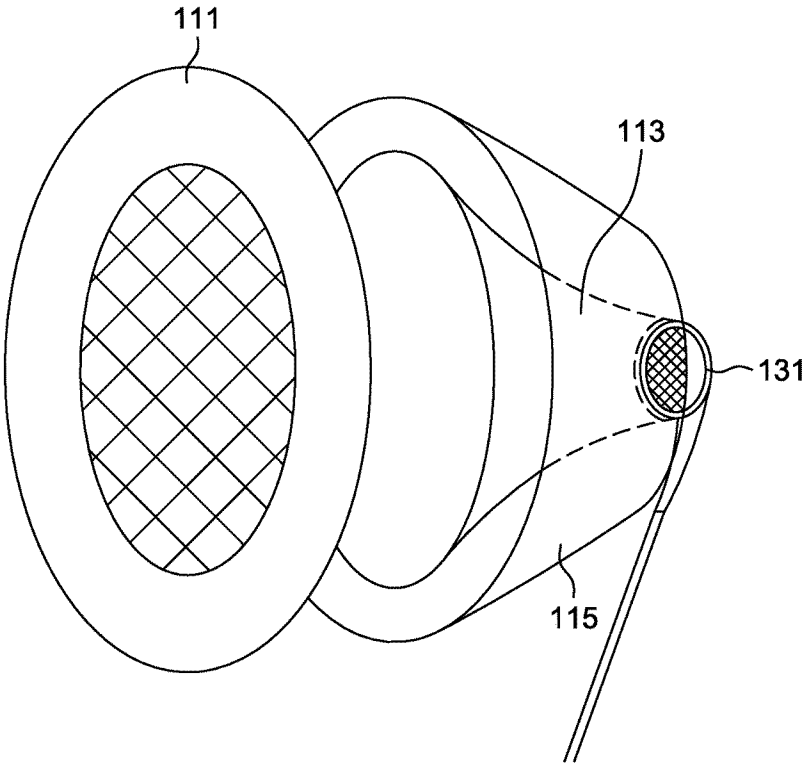
FIG. 3 illustrates a perspective view of the headphone and earbuds device of the present invention.

FIG. 3 illustrates a perspective view of a headphone 101, 103 and illustrates the earbud device 131 inserted in aperture 109, the ear cushion member 111, the speaker acoustic device 113, and the speaker chamber 115.

Figure 4:
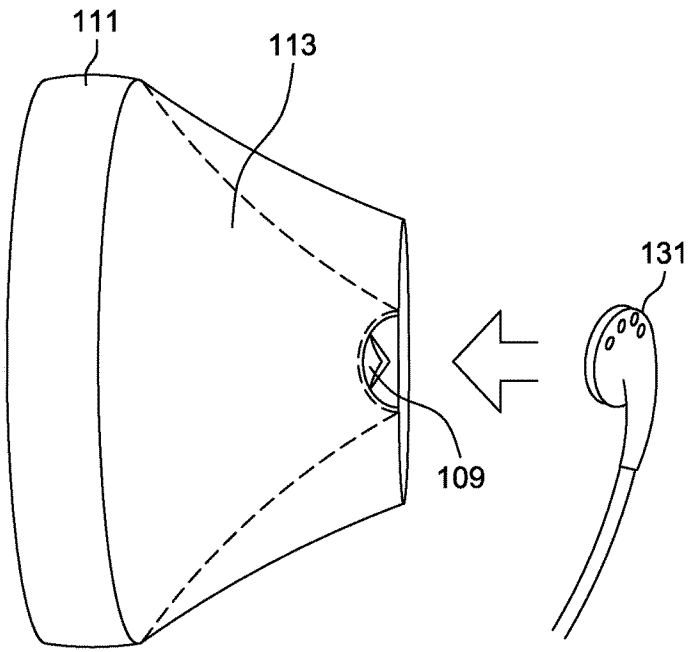
FIG. 4 illustrates a front view of the headphone and earbuds device of the present invention.

FIG. 4 illustrates a front view of a headphone 101, 103 and illustrates the earbud device 131 being inserted into the headphone 101, 103, at aperture 109, the ear cushion member 111, and the speaker acoustic device 113.

Figure 5:
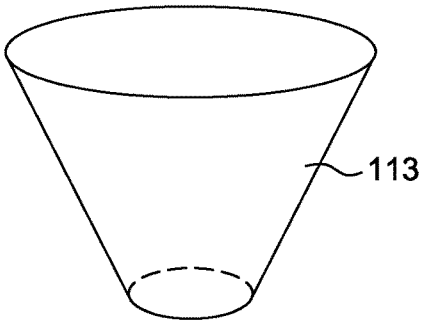
FIGS. 5-10 illustrate a perspective view of the speaker acoustic device of the present invention.

FIG. 5 illustrates a speaker acoustic device 113 which may be a truncated cone.

Figure 6:
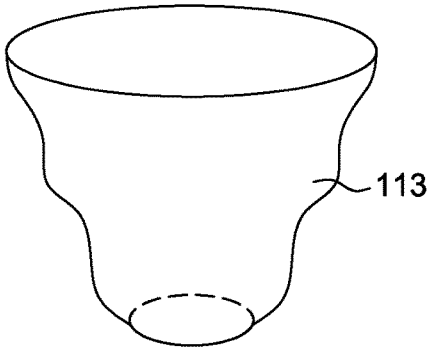

FIG. 6 illustrates a speaker acoustic device 113 which may include a truncated cone with concave curved surfaces and convex curved surfaces.

Figure 7:
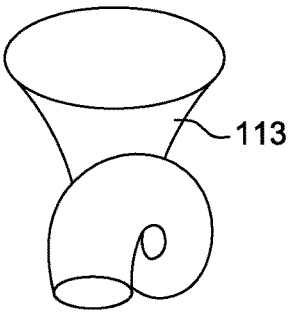

FIG. 7 illustrates a speaker acoustic device 113 which may be a trumpet shaped having a neck which reverses in direction.

Figure 8:
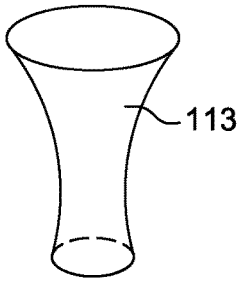

FIG. 8 illustrates a speaker acoustic device 113 which may be trumpet shaped.

Figure 9:
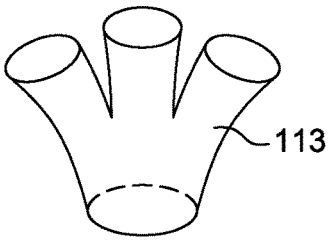

FIG. 9 illustrates a speaker acoustic device 113 which may include multiple trumpet shaped devices from a common base.

Figure 10:
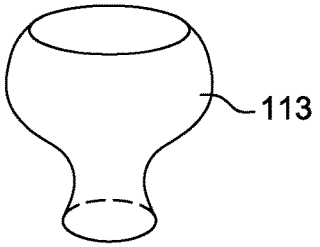

FIG. 10 illustrates a speaker acoustic device 113 which may include a convex surface and a concave surface.

Figure 11:
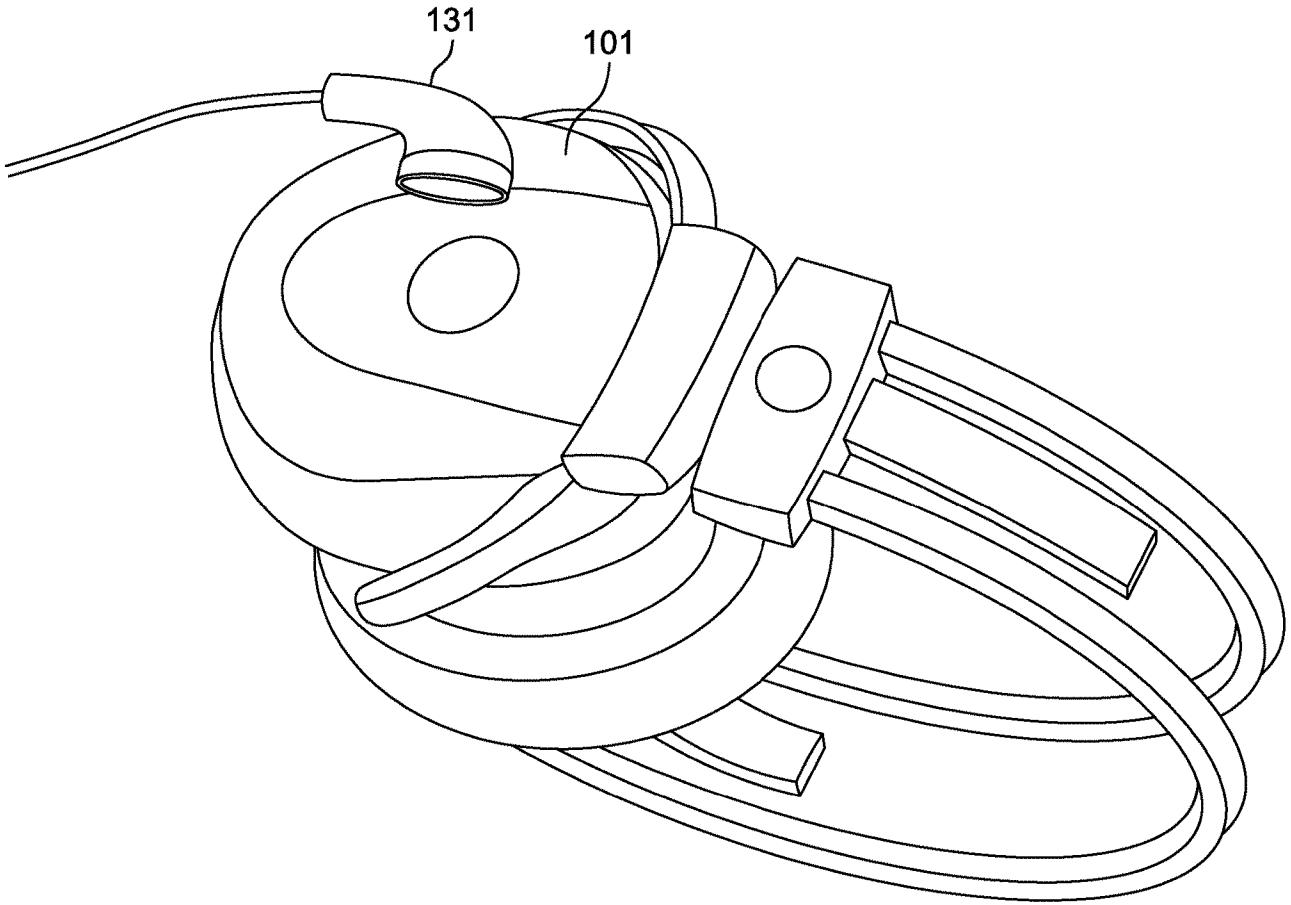
FIG. 11 illustrates a perspective view of a detached headphone and earbuds.

FIG. 11 illustrates a perspective view of the earbud device 131 being inserted into the first headphone 101.

Figure 12:
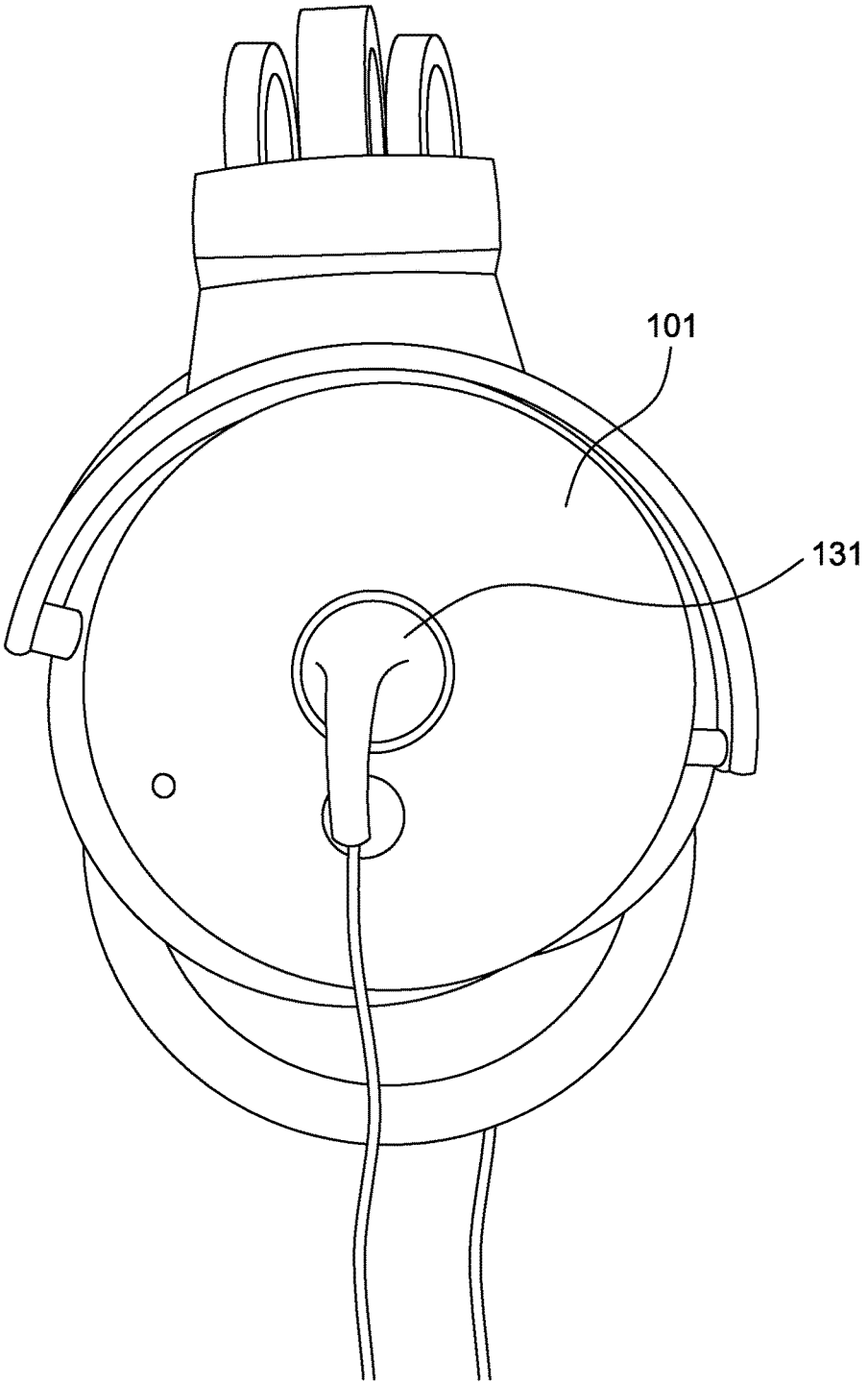
FIG. 12 illustrates a perspective view of connected headphone and earbuds.

FIG. 12 illustrates a perspective view of the earbud device 131 positioned within the first headphone 101.

Figure 13:
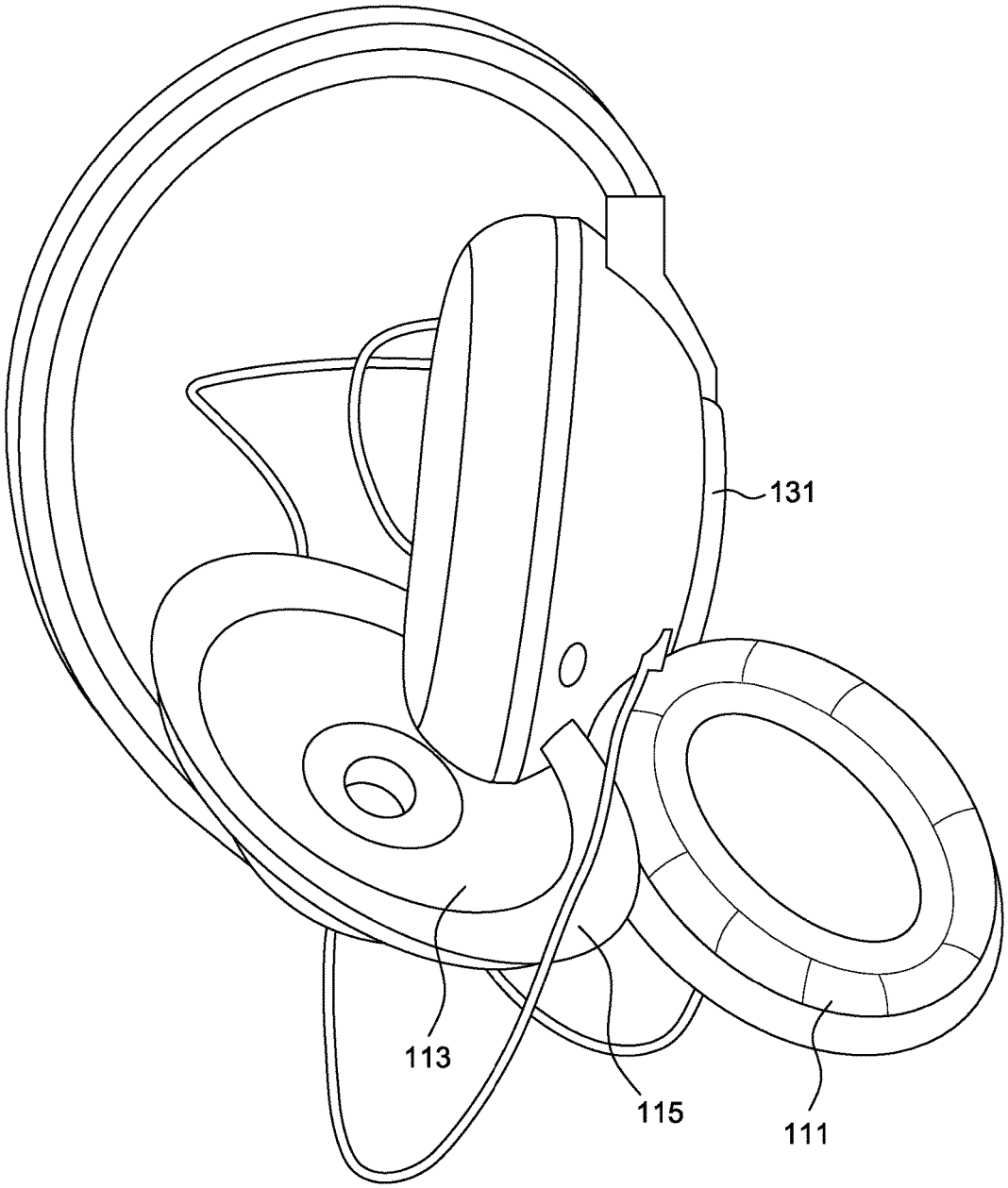
FIG. 13 illustrates a perspective view of the headphone and earbuds device of the present invention.

FIG. 13 illustrates a perspective view of the headphones 101, 103 with earbud 131 inserted in headphone 101, headphone acoustic device 113, speaker chamber 115, and ear cushion member 111.

Figure 14:
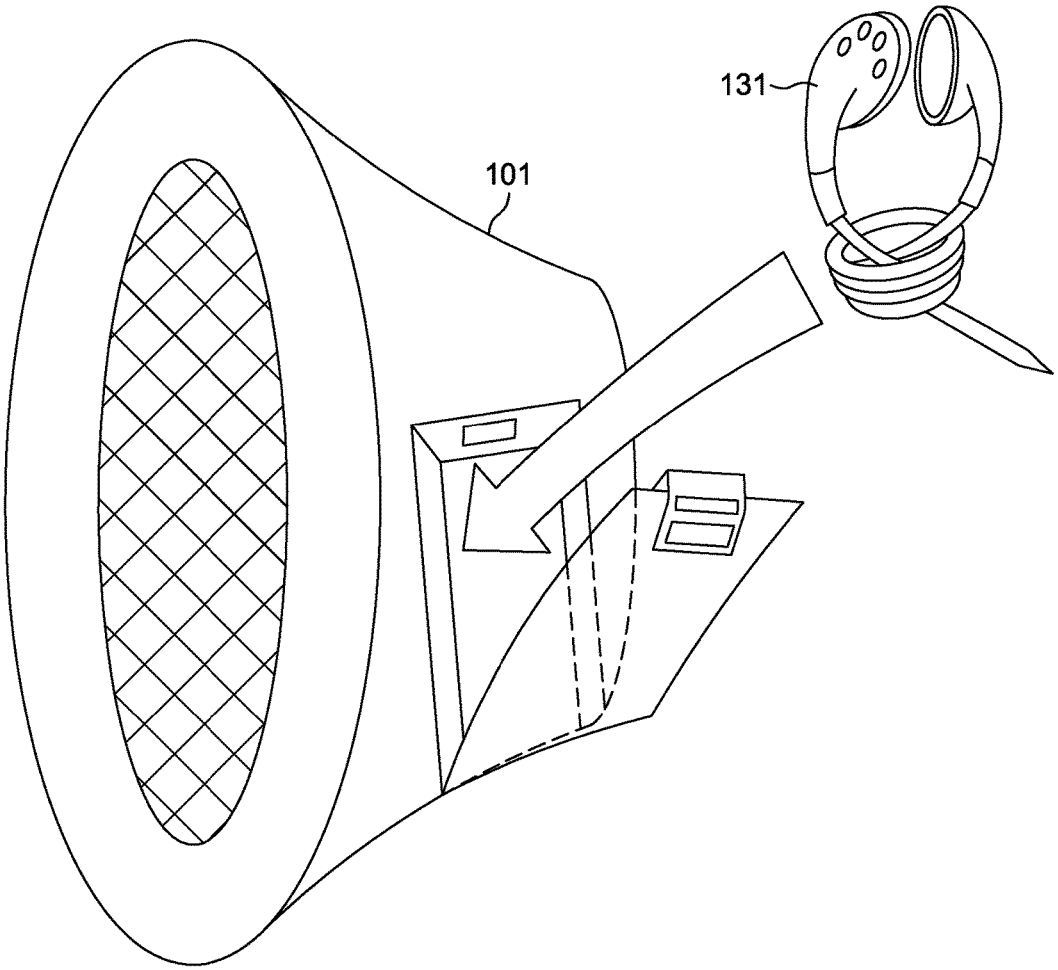
FIG. 14 illustrates a perspective view of an earbud storage compartment of the headphone of the present invention.

FIG. 14 illustrates headphone 101 which may include an earbud containing compartment for earbud device, 131.

Figure 15:
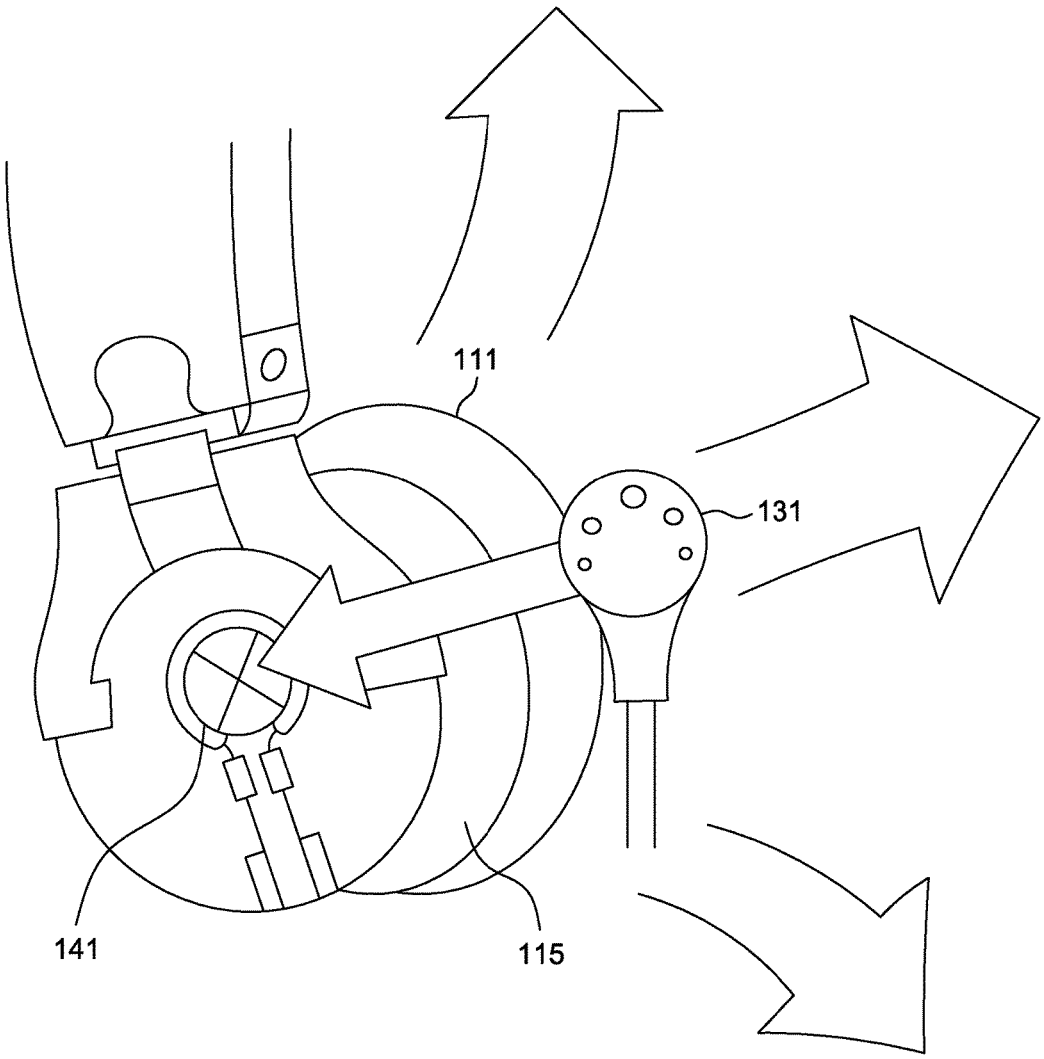
FIG. 15 illustrates a perspective view of the headphone and earbud device of the present invention.

FIG. 15 illustrates the ear cushion member 111 and the speaker chamber 115, and FIG. 15 may additionally illustrate the speaker acoustic device 113. The speaker acoustic device 113 may include an amplification device 141 which may be a microphone or other device to collect acoustic signals from the earbud device 131 and amplify the transmitted acoustic signals to the user.

Figure 16:
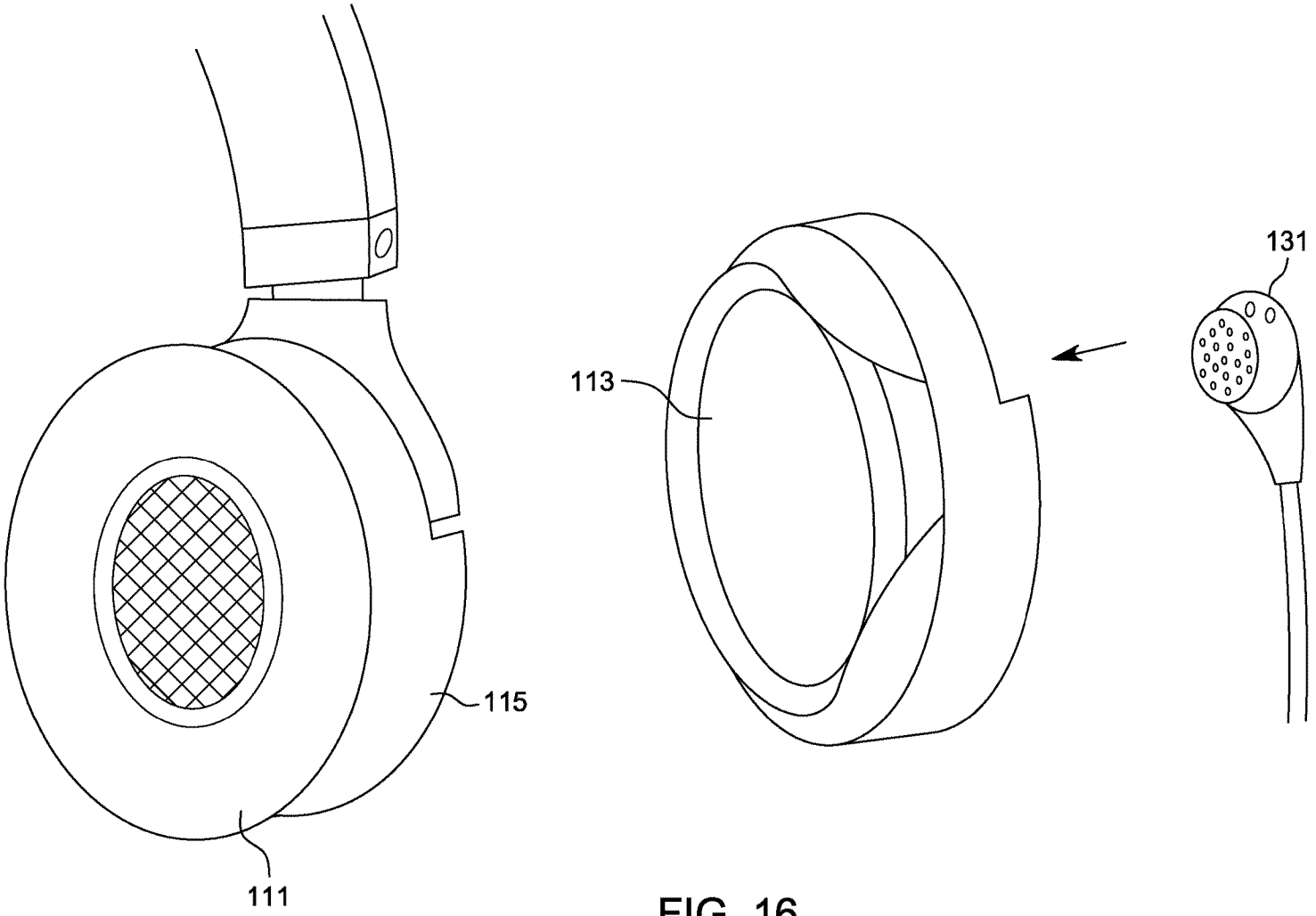
FIG. 16 illustrates a perspective view of the headphone and earbud device of the present invention.

FIG. 16 illustrates the speaker chamber 115 and an ear bud device 131, and FIG. 16 additionally illustrates the ear cushion member 111 and the speaker acoustic device 113 of the present invention.

Figure 17:
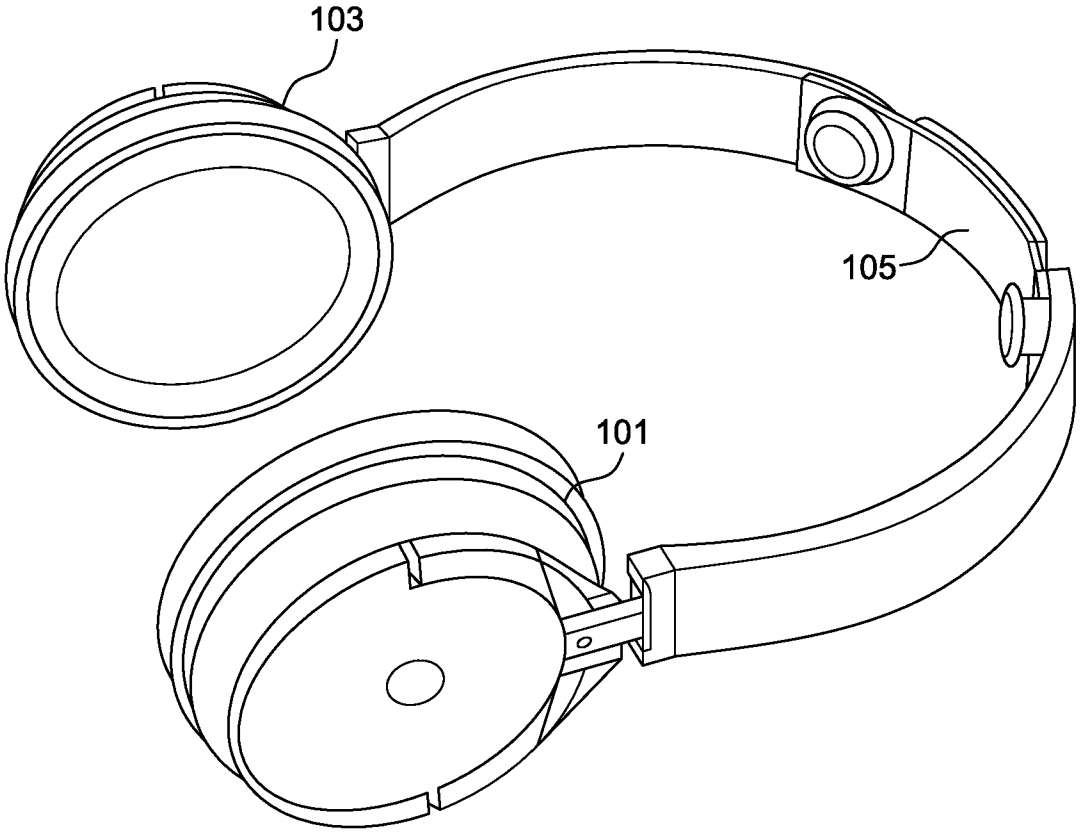
FIG. 17 illustrates a perspective view of a headphone without the earbuds.

FIG. 17 illustrates a perspective view of the first headphone 101, the second headphone 103 and the headphone headband 105.

Figure 18:
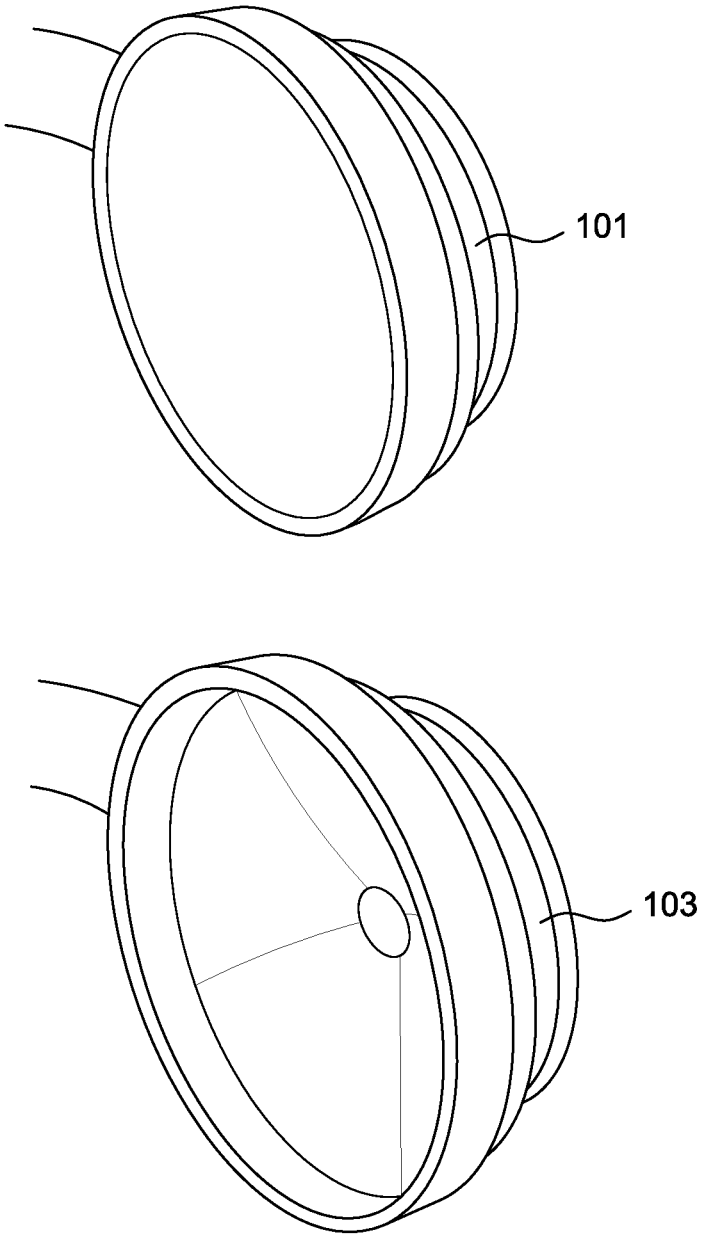
FIG. 18 illustrates a perspective view of the first headphone.

FIG. 18 illustrates a sectional view of the first headphone 101 and the second headphone 103.

Figure 19:
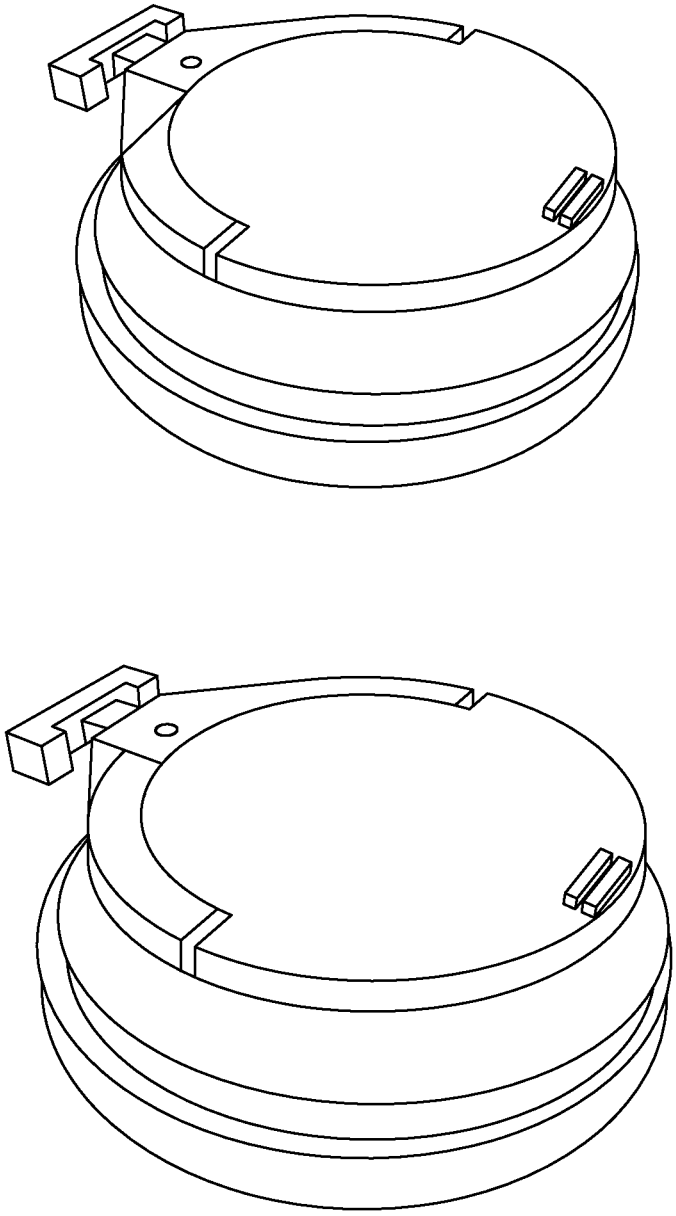
FIG. 19 illustrates another perspective view of the first headphone.

FIG. 19 illustrates a sectional view of the first headphone 101 and the second headphone 103.

Figure 20:
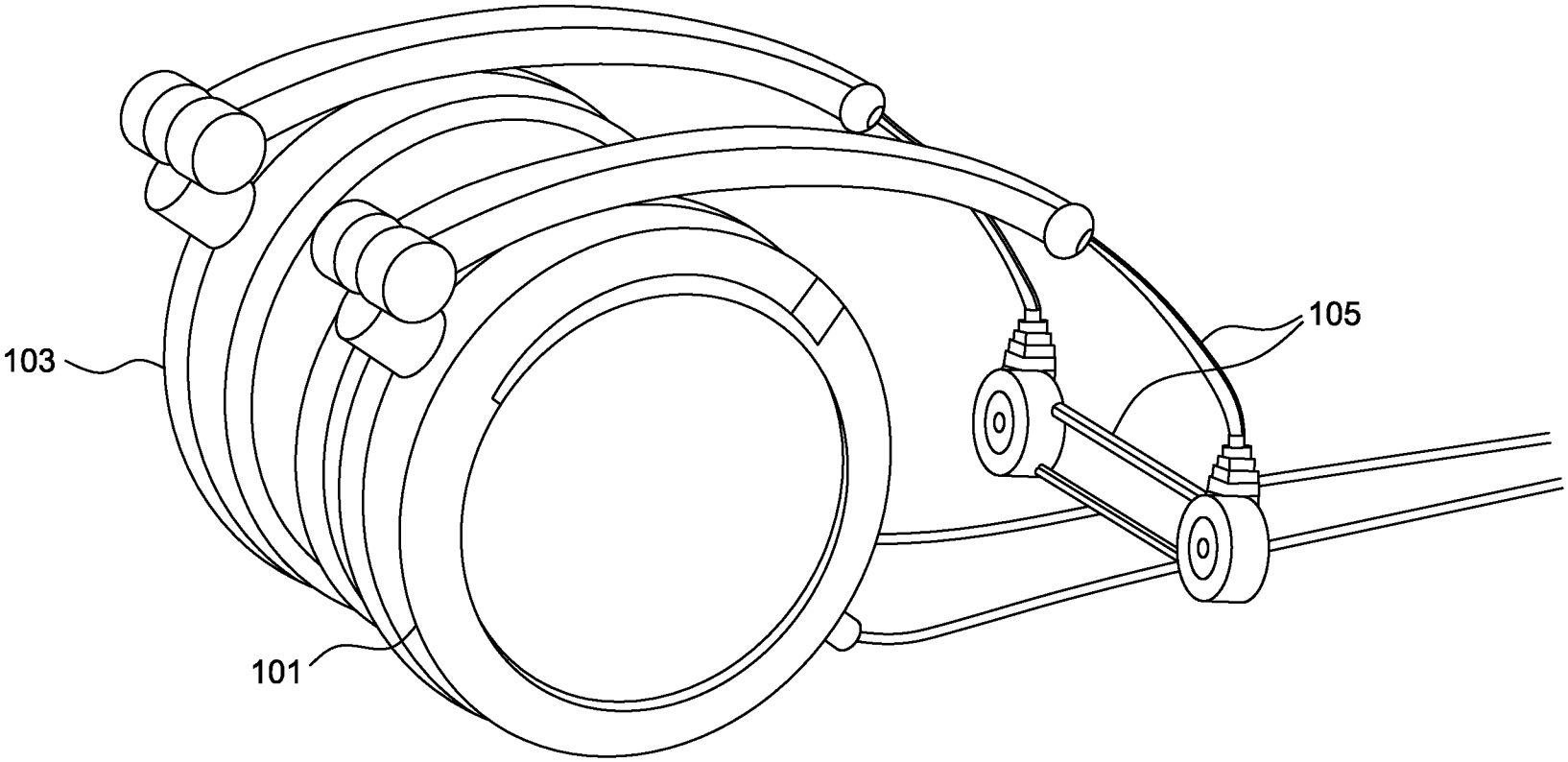
FIGS. 20-23 illustrates a perspective view of folding headphones.

FIG. 20 illustrates a first headphone 101 and the second headphone 103 being folded together by a folding headphone headband 105, and the first headphone 101 and the second headphone 103 may be adapted to receive the earbud device 131 (not shown).

Figure 21:
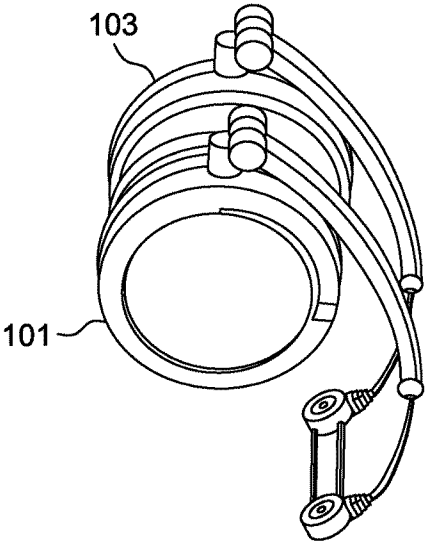

FIG. 21 illustrates a perspective view of the first headphone 101 and the second headphone 103 in a first position which may be folded.

Figure 22:
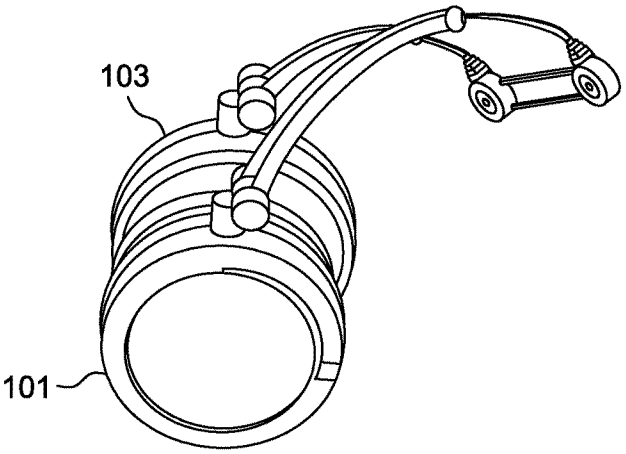

FIG. 22 illustrates a perspective view of the first headphone 101 and the second headphone 103 in a second position which may be partially unfolded.

Figure 23:
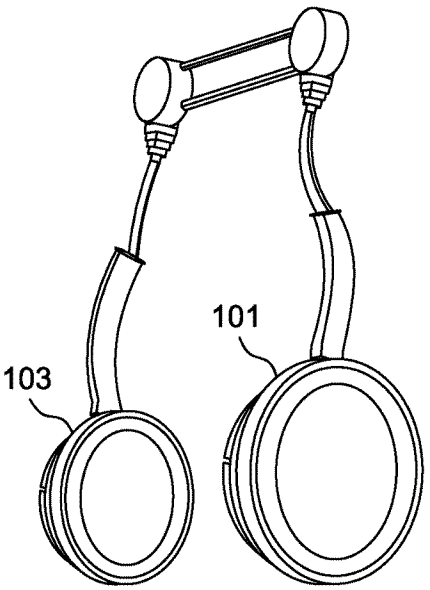

FIG. 23 illustrates a perspective view of the first headphone 101 and the second headphone 103 in a third position which may be fully unfolded.

FIGS. 24-28 illustrates additional features of the present invention which may include a cylinder tube having several advantages. The present invention provides a substantially direct channel from the earbud to the users ear channel. The present invention may concentrate the sound energy in the cylindrical tube by maintaining the sound energy. The present invention concentrates volume and provides clarity of sound from the earbud. In effect, the present invention creates an extension of the ear canal of the user to provide for direct travel of this sound.

Figure 24:
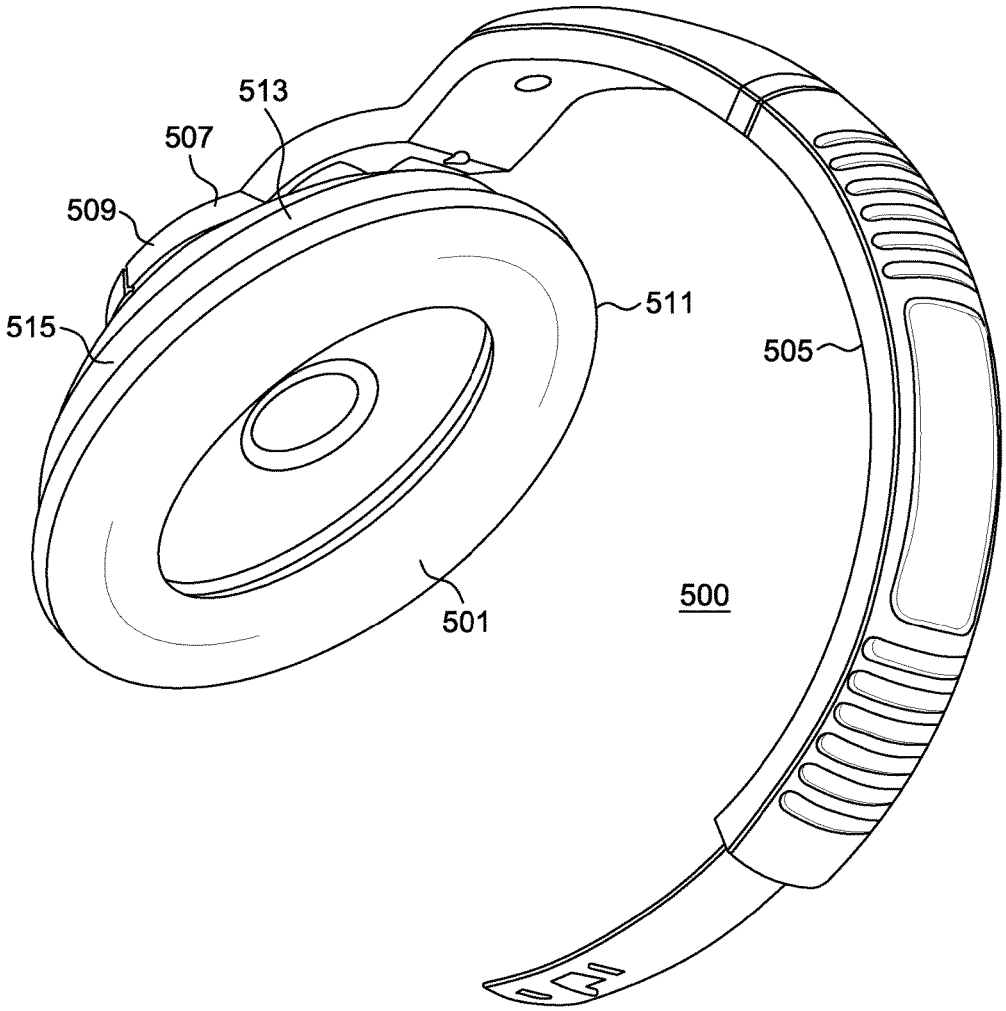
FIG. 24-26 illustrates a perspective view of another embodiment of the headphones of the present invention.

FIG. 24 illustrates a perspective view of the headphone and ear buds device 500 of the present invention which may include a first headphone 501 and a near mirror second headphone 503 (not shown). The description of the first headphone 501 may apply equally to the second headphone 503. The first headphone 501 may be connected to the second headphone 503 by a headphone headband 505 which may be substantially U-shaped, adjustable and flexible in order to accommodate varying users head sizes. The headband 505 may include a first portion which may telescope into a second portion in order to vary the size of the headband 505. The headphone headband 505 may include a connector 507 with the first headphone 501 and the second headphone 503 to allow the respective headphone 501, 503 to rotate to provide a rotating operation. Each headphone 501, 503 may include a headphone aperture 509 which may or may not interfere with the operation of the headphone 501, 503 and may be substantially centered on the exterior surface (distal side) of the headphone 501, 503. The headphone 501, 503 may include an ear cushion member 511 which may be a elongated flexible ring to cushion the headphone 501, 503 from the ear of the user and may include a speaker acoustic device 513 which may include a speaker chamber 515 which may be dome shaped and may cooperate with ear cushion member 511.

Figure 25:
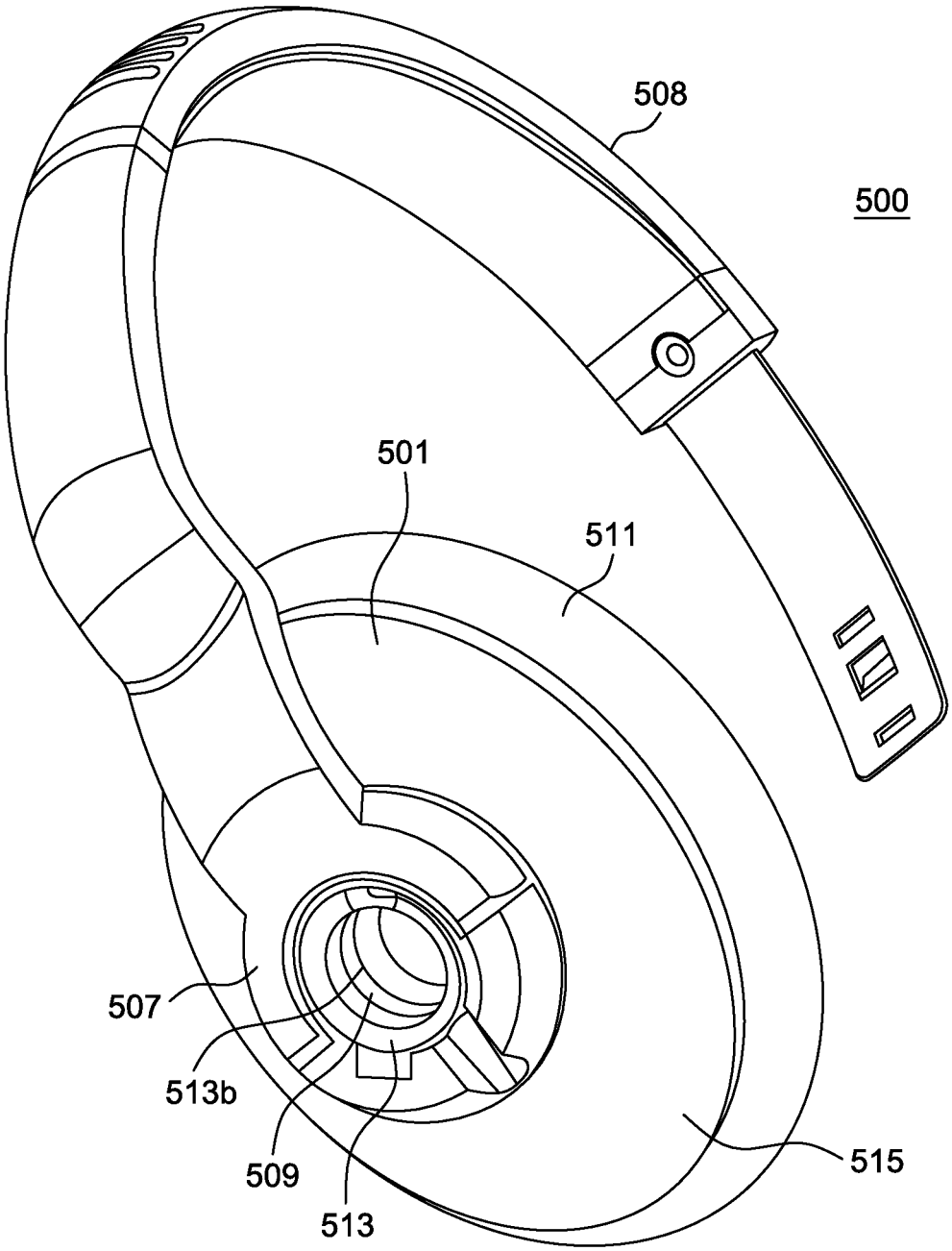

FIG. 25 illustrates a perspective view of the headphone and ear buds device 500 of the present invention which may include a first headphone 501 and a near mirror second headphone 503 (not shown). The description of the first headphone 501 may apply equally to the second headphone 503. The first headphone 501 may be connected to the second headphone 503 by a headphone headband 505 which may be substantially U-shaped, adjustable and flexible in order to accommodate varying users head sizes. The headphone headband 505 may include a connector 507 with the first headphone 501 and the second headphone 503 to allow the respective headphone 501, 503 to rotate to provide a rotating operation. Each headphone 501, 503 may include a headphone aperture 509 which may or may not interfere with the operation of the headphone 501, 503 and may be substantially centered on the exterior surface (distal side) of the headphone 501, 503. The headphone 501, 503 may include an ear cushion member 511 which may be a elongated flexible ring to cushion the headphone 501, 503 from the ear of the user and may include a speaker acoustic device 513 which may include a speaker chamber 515 which may be dome shaped and may cooperate with ear cushion member 511.

FIG. 25 illustrates a speaker acoustic device 513 which may include a cylinder (tube) being defined by a cylinder wall 513*a* and an aperture 513*b*.

Figure 26:
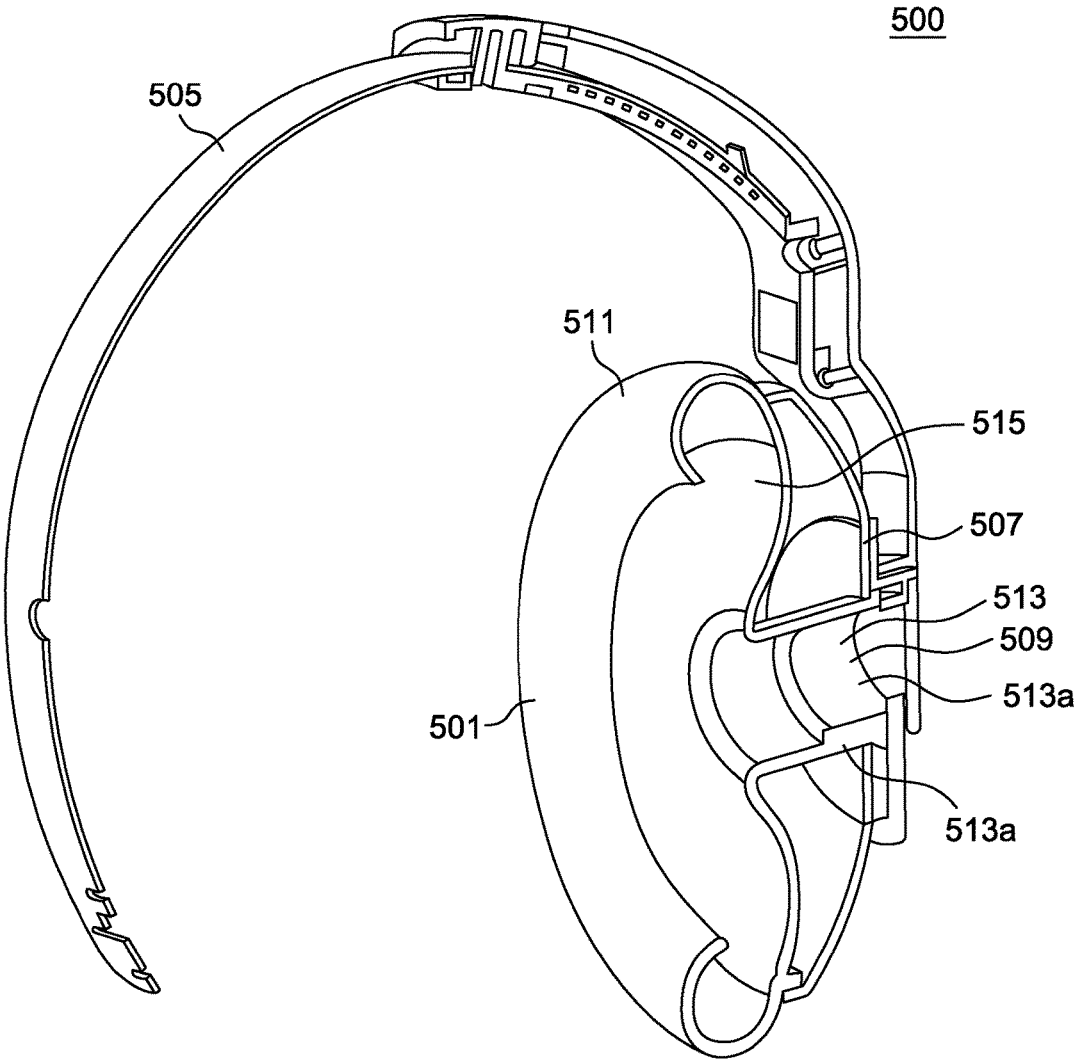

FIG. 26 illustrates a perspective view and cross-sectional view of the headphone and ear buds device 500 of the present invention which may include a first headphone 501 and a near mirror second headphone 503 (not shown). The description of the first headphone 501 may apply equally to the second headphone 503. The first headphone 501 may be connected to the second headphone 503 by a headphone headband 505 which may be substantially U-shaped, adjustable and flexible in order to accommodate varying users head sizes. The headphone headband 505 may include a connector 507 with the first headphone 501 and the second headphone 503 to allow the respective headphone 501, 503 to rotate to provide a rotating operation. Each headphone 501, 503 may include a headphone aperture 509 which may or may not interfere with the operation of the headphone 501, 503 and may be substantially centered on the exterior surface (distal side) of the headphone 501, 503. The headphone 501, 503 may include an ear cushion member 511 which may be a elongated flexible ring to cushion the headphone 501, 503 from the ear of the user and may include a speaker acoustic device 513 which may include a speaker chamber 515 which may be dome shaped or may be shaped to correspond to the ear cushion member 511 and may cooperate with ear cushion member 511.

FIG. 26 illustrates a speaker acoustic device 513 which may include a cylinder (tube) being defined by a cylinder wall 513*a* and an aperture 513*b*.

Figure 27:
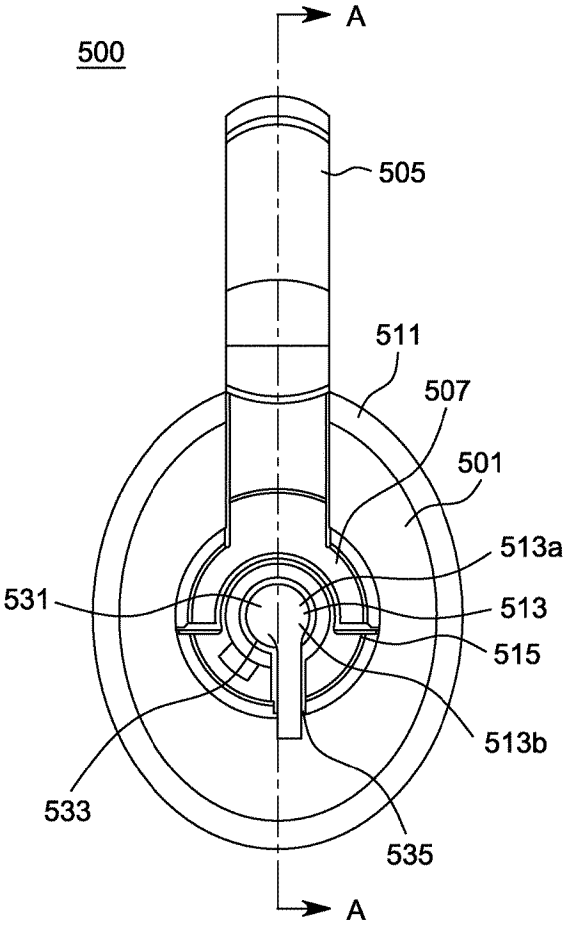
FIG. 27 illustrates a side view of the headphones of the present invention.

FIG. 27 illustrates a side view of the headphone and ear buds device 500 of the present invention which may include a first headphone 501 and a near mirror second headphone 503 (not shown). The description of the first headphone 501 may apply equally to the second headphone 503. The first headphone 501 may be connected to the second headphone 503 by a headphone headband 505 which may be substantially U-shaped, adjustable and flexible in order to accommodate varying users head sizes. The headphone headband 505 may include a connector 507 with the first headphone 501 and the second headphone 503 to allow the respective headphone 501, 503 to rotate to provide a rotating operation. Each headphone 501, 503 may include a headphone aperture 509 which may or may not interfere with the operation of the headphone 501, 503 and may be substantially centered on the exterior surface (distal side) of the headphone 501, 503. The headphone 501, 503 may include an ear cushion member 511 which may be an elongated flexible ring to cushion the headphone 501, 503 from the ear of the user and may include a speaker acoustic device 513 which may include a speaker chamber 515 which may be dome shaped or may be shaped to correspond to the ear cushion member 511 and may cooperate with ear cushion member 511.

FIG. 27 illustrates a speaker acoustic device 513 which may include a cylinder (tube) being defined by a cylinder wall 513*a* and an aperture 513*b*.

FIG. 27 illustrates the earbud device 531 which may include an earbud speaker 533 which may be connected to an earbud wire 535 which may be flexible and connect to the earbud speaker 533 to allow the earbud speaker 533 to receive audio signals from an audio source (not shown). The earbud speaker 533 may cooperate with the aperture 513*b* to achieve a detachable connection for example by a friction fit.

FIG. 27 additionally illustrates headphone speaker wire 535 to provide audio signals to the headphone 501, 503.

Figure 28:
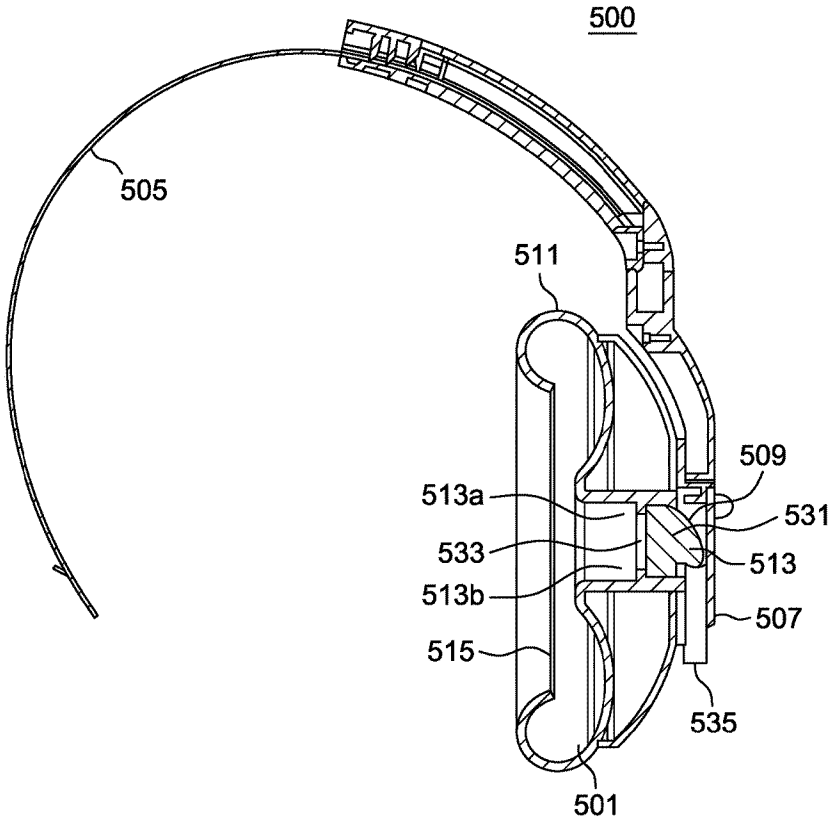
FIG. 28 illustrates a cross-sectional view of the headphones of the present invention.

FIG. 28 illustrates a cross-sectional view of the headphone and ear buds device 500 of the present invention which may include a first headphone 501 and a near mirror second headphone 503 (not shown). The description of the first headphone 501 may apply equally to the second headphone 503. The first headphone 501 may be connected to the second headphone 503 by a headphone headband 505 which may be substantially U-shaped, adjustable and flexible in order to accommodate varying users head sizes. The headphone headband 505 may include a connector 507 with the first headphone 501 and the second headphone 503 to allow the respective headphone 501, 503 to rotate to provide a rotating operation. Each headphone 501, 503 may include a headphone aperture 509 which may or may not interfere with the operation of the headphone 501, 503 and may be substantially centered on the exterior surface (distal side) of the headphone 501, 503. The headphone 501, 503 may include an ear cushion member 511 which may be an elongated flexible ring to cushion the headphone 501, 503 from the ear of the user and may include a speaker acoustic device 513 which may include a speaker chamber 515 which may be dome shaped or may be shaped to correspond to the ear cushion member 511 and may cooperate with ear cushion member 511.

FIG. 28 illustrates a speaker acoustic device 513 which may include a cylinder (tube) being defined by a cylinder wall 513*a* and an aperture 513*b*.

FIG. 28 illustrates the earbud device 531 which may include an earbud speaker 533 which may be connected to an earbud wire 535 which may be flexible and connect to the earbud speaker 533 to allow the earbud speaker 533 to receive audio signals from an audio source (not shown). The earbud speaker 533 may cooperate with the aperture 513*b* to achieve a detachable connection for example by a friction fit.

FIG. 28 additionally illustrates headphone speaker wire 535 to provide audio signals to the headphone 501, 503.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A headphone system, comprising:
an inner conical component; and
an outer conical component, wherein:
the inner conical component is positioned within the outer conical component, such that at least one confined space exists between at least a portion of the interior surface of the outer conical component and at least a portion of the exterior surface of the inner conical component;
the inner conical component and the outer conical component are coaxial; and
the inner conical component includes an aperture positioned at the narrower end of the inner conical component and on the axis shared with the outer conical component, wherein the aperture is configured to detachably mate with an earbud listening device.

2. A headphone system as in claim 1, wherein the aperture is configured to detachably mate with the earbud listening device via a frictional connection.

3. A headphone system as in claim 1, wherein the aperture is configured to detachably mate with the earbud listening device via a mechanical connection.

4. A headphone system as in claim 1, further comprising an ear cushion member.

5. A headphone system as in claim 1, wherein the outer conical component comprises a compartment for storing the earbud listening device.

6. A headphone system as in claim 1, further comprising an amplification device connected to the aperture.

7. A headphone system as in claim 6, wherein the amplification device comprises a microphone.

8. A headphone system as in claim 6, wherein the amplification device comprises a megaphone.

9. A headphones system, comprising:
a first headphone, wherein the first headphone comprises:
an inner conical component; and
an outer conical component, wherein:
the inner conical component is positioned within the outer conical component, such that at least one confined space exists between at least a portion of the interior surface of the outer conical component and at least a portion of the exterior surface of the inner conical component;
the inner conical component and the outer conical component are coaxial; and
the inner conical component includes an aperture positioned at the narrower end of the inner conical component and on the axis shared with the outer conical component, wherein the aperture is configured to detachably mate with an earbud listening device; and
a second headphone, wherein the second headphone comprises:
an inner conical component; and
an outer conical component, wherein:
the inner conical component is positioned within the outer conical component, such that at least one confined space exists between at least a portion of the interior surface of the outer conical component and at least a portion of the exterior surface of the inner conical component;
the inner conical component and the outer conical component are coaxial; and
the inner conical component includes an aperture positioned at the narrower end of the inner conical component and on the axis shared with the outer conical component, wherein the aperture is configured to detachably mate with an earbud listening device; and
wherein the first headphone is connected to the second headphone.

10. A headphones system as in claim 9, wherein the first headphone and the second headphone are foldable.

11. A headphones system as in claim 9, wherein the first headphone is connected to the second headphone by a headband.

12. A headphones system as in claim 11, wherein the headband comprises telescope mechanism with at least a first position and a second position, wherein the first position and the second position are configured to accommodate respective sizing parameters.

13. A headphones system as in claim 9, further comprising a connector configured to rotate the first headphone with respect to the second headphone.

14. A headphones system as in claim 9, wherein each aperture is configured to detachably mate with a earbud listening device via a frictional connection.

15. A headphones system as in claim 9, wherein each aperture is configured to detachably mate with the earbud listening device via a mechanical connection.

16. A headphones system as in claim 9, further comprising:

an ear cushion member connected to the first headphone; and an ear cushion member connected to the second headphone.

17. A headphones system as in claim 9, wherein each outer conical component comprises a compartment for storing an earbud listening device.

18. A headphones system as in claim 9, further comprising an amplification device connected to each aperture.

19. A headphones system as in claim 18, wherein the amplification device comprises a microphone.

20. A headphones system as in claim 18, wherein the amplification device comprises a megaphone.

* * * * *